US008230544B2

(12) United States Patent
Leshko

(10) Patent No.: US 8,230,544 B2
(45) Date of Patent: Jul. 31, 2012

(54) MULTIPURPOSE CLEANING BRUSH

(76) Inventor: Steven J. Leshko, New Lenox, IL (US)

( * ) Notice: Subject to any disclaimer, the term of this patent is extended or adjusted under 35 U.S.C. 154(b) by 934 days.

(21) Appl. No.: 12/283,530

(22) Filed: Sep. 12, 2008

(65) Prior Publication Data

US 2010/0064460 A1 Mar. 18, 2010

(51) Int. Cl.
*A46B 5/02* (2006.01)

(52) U.S. Cl. ..... 15/160; 15/106; 15/167.3; 15/DIG. 5

(58) Field of Classification Search ..... 15/106, 15/160, 167.2, 167.3, DIG. 5; D4/119, 120, D4/130

See application file for complete search history.

(56) References Cited

U.S. PATENT DOCUMENTS 4,480,351 A * 11/1984 Koffler ..... 15/187
D294,887 S * 3/1988 Young ..... D4/120
5,211,494 A 5/1993 Baijnath
6,210,057 B1 4/2001 Yannaci et al.
6,439,790 B1 8/2002 Kay
6,629,799 B2 10/2003 Flores, Jr.
6,983,866 B2 1/2006 Smart et al.

* cited by examiner

*Primary Examiner* — Randall Chin
(74) *Attorney, Agent, or Firm* — James Ray & Assoc.

(57) ABSTRACT

A multipurpose brush includes a body with a first portion having each of a top surface, opposed bottom surface and a peripheral edge, and with a second portion having each of a first surface thereof disposed on and secured to one of the bottom and top surface of the first portion, an opposed bottom surface thereof. At least one set of bristles is secured to and extending outwardly from at least one predetermined surface of the body. The second portion may have a generally triangular cross-section disposed in a plane generally planar to the one of the bottom and top surface of the first portion and may also have a pair of concave ends. A third portion is also provided in generally planar relationship with the first portion and may be adapted for scrubbing and exfoliating human skin, particularly of feet.

18 Claims, 2 Drawing Sheets

MULTIPURPOSE CLEANING BRUSH

FIELD OF THE INVENTION

The present invention relates, in general, to cleaning brushes and, more particularly, this invention relates to such a brush provided with an arched row of hard fingernail cleaning bristles located on its top surface and with a between-fingers cleaning middle portion having a triangular cross-section.

BACKGROUND OF THE INVENTION

As is generally known, stubborn dirt, oil and grime that are often left behind after a day of work or play are not easily dislodged from the small areas and crevices of the hand and nails and even scrubbing with a standard brush can leave much of the residue behind. Often, a greater than desired effort is required to repeatedly brush and scrub user's hands and fingers in order to remove a day's worth of soils, dirt and debris.

Prior to the conception and design of the present invention, efforts have been made to alleviate difficulties of cleaning portions of the human anatomy. For example, U.S. Pat. No. 4,480,351 issued to Koffier and U.S. Pat. No. 6,289,547 issued to Narula et al. provide bristle-containing brushes scrub brushes for surgical applications and include provisions for cleaning under the nail plates. However, a particular disadvantage of these prior art bristle-containing brushes in effectively cleaning the inner skin surfaces of a pair of adjacent fingers and skin surfaces disposed in closed proximity to the finger knuckles.

Furthermore, as it is generally known, bristle-containing brushes are employed for cleaning articles of produce, such as carrots, potatoes, mushrooms and the like and are also employed for cleaning various objects, for example such as railing and particularly railing on watercrafts. However, the design of each prior art brush requires a user to maintain different brushes for each specific application.

Therefore, there is a need for an improved multipurpose cleaning brush enabling a user to clean portions of the human anatomy, articles of produce and other various objects.

SUMMARY OF THE INVENTION

In a first aspect, the present invention provides a multipurpose brush. The brush includes a body. The body includes a first portion that has each of a top surface, opposed bottom surface and a peripheral edge. There is also a second portion that has each of a first surface thereof disposed on and secured to one of the bottom and top surface of the first portion, an opposed bottom surface thereof and a generally triangular cross-section disposed in a plane generally planar to the one of the bottom and top surface of the first portion. At least one set of bristles is secured to and extending outwardly from at least one predetermined surface of the body.

In a second aspect, the present invention provides a multipurpose brush that includes a body having at least one substantially planar surface. A set of bristles is secured to and extends outwardly from the at least one substantially planar surface. The bristles are convexly arched in a plane generally perpendicular to the at least one substantially planar surface. Longer bristles within the set are located toward the middle of the at least one substantially planar surface.

In a third aspect, the present invention provides a multipurpose brush. The brush includes a body. The body includes a first portion having each of a top surface, opposed bottom surface and a peripheral edge. The body also includes a second portion having each of a first surface thereof disposed on and secured to one of the bottom and top surface of the first portion, an opposed bottom surface thereof and a pair of ends disposed generally perpendicular to the first portion, wherein at least one of the pair of ends has a predetermined concave shape. At least one set of bristles is secured to and extends outwardly from at least one predetermined surface of the body.

In a forth aspect, the present invention provides a cleaning brush for use with at least one portion of a human anatomy. The brush includes a body. The body includes a top portion having each of a top planar surface, opposed bottom planar surface and a peripheral edge, the top portion manufactured from a compressible composite rubber material having memory retention. A bottom portion is provide and has each of a top planar surface, opposed bottom planar surface and a peripheral edge. The bottom portion is also manufactured from the compressible memory retention composite rubber material. The bottom surface of the top portion and the top surface of the bottom portion are disposed substantially parallel to each other. A middle portion is also provided and has each of a top surface thereof disposed on and secured to the bottom surface of the top portion, a bottom surface thereof disposed on and secured with the adhesive to the top surface of the bottom portion, and a pair of opposed ends. Each of the pair of opposed ends curving inwardly in a plane substantially perpendicular to each of the bottom surface of the top portion and the top surface of the bottom portion. A generally triangular cross-section of the middle portion is disposed in a plane substantially parallel to the each of the bottom surface of the top portion and the top surface of the bottom portion. The middle portion is manufactured from a substantially rigid plastic material. A first set of equal height bristles is secured to and extends outwardly from the top surface of the top portion and defines a substantially planar upper brushing surface. A second set of equal height bristles is secured to and extends outwardly from the bottom surface of the top portion and defines a substantially planar first interior brushing surface. A third set of equal height bristles is secured to and extends outwardly from the top surface of the bottom portion and defines a substantially planar second interior brushing surface. A fourth set of equal height bristles is secured to and extends outwardly from the bottom surface of the bottom portion and defines a substantially planar lower brushing surface. A fifth set of equal height bristles is secured to and extends outwardly from a peripheral surface of the middle portion. There is also a set of variable length nail cleaning bristles that is secured to and extends outwardly from at least one of the top surface of the top portion and the bottom surface of the bottom portion and having a hardness being one of equal to and greater than a respective one of the first and third set of bristles. Free ends of the nail cleaning bristles are convexly arched in a plane substantially perpendicular to the at least one of the top surface of the top portion and the bottom surface of the bottom portion. Longer bristles within the set are located toward the middle of the at least one of the top surface of the top portion and the bottom surface of the bottom portion. A predetermined distance is formed between the first and second inner brushing surfaces for cleaning upper and lower skin surfaces of a pair of adjacent fingers or toes in a substantially simultaneous manner. The cross-section of the middle portion is sized to enable a portion of the fifth set of bristles to clean each of inner skin surfaces of the pair of fingers or toes and skin surfaces disposed in closed proximity to respective knuckles in the substantially simultaneous manner.

OBJECTS OF THE INVENTION

It is, therefore, one of the primary objects of the present invention to provide a multipurpose cleaning brush that has a plurality of bristle based brush surfaces.

Another object of the present invention is to provide a multipurpose cleaning brush that has a row of arched bristles for cleaning under nail plates of the user.

Yet another object of the present invention is to provide a multipurpose cleaning brush that has a triangular cross-section for cleaning between a pair of adjacent fingers or toes.

A further object of the present invention is to provide a multipurpose cleaning brush that has a curved portion for cleaning cylindrically shaped objects and/or articles of produce.

Yet a further object of the present invention is to provide a multipurpose cleaning brush that has means for removing outer layer of a human skin.

An additional object of the present invention is to provide a multipurpose cleaning brush that has means for exfoliating skin of feet.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
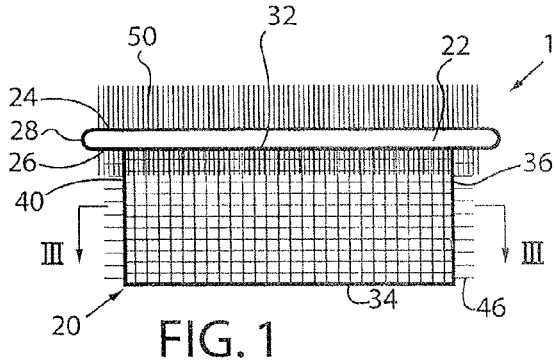
FIG. 1 is a front elevation view of a multipurpose cleaning brush in accordance with one form of the present invention.

Prior to proceeding to the more detailed description of the present invention, it should be noted that, for the sake of clarity and understanding, identical components which have identical functions have been identified with identical reference numerals throughout the several views illustrated in the drawing figures.

Figure 2:
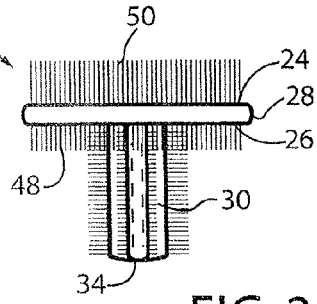
FIG. 2 is a side elevation view of the multipurpose cleaning brush of FIG. 1.
Figure 3:
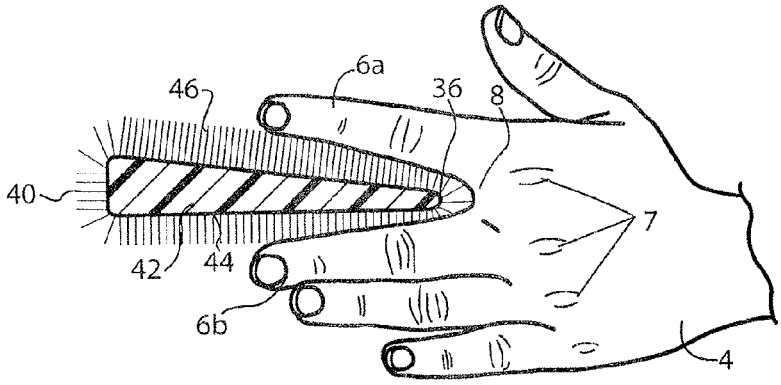
FIG. 3 is a cross-sectional view of the multipurpose cleaning brush along lines III-III of FIG. 1.
Figure 4:
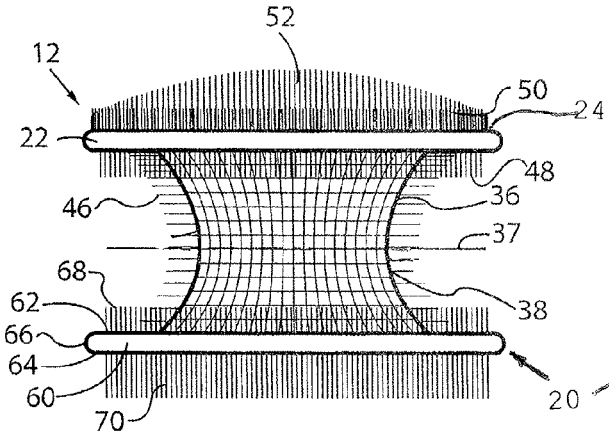
FIG. 4 is a front elevation view of a multipurpose cleaning brush in accordance with another form of the present invention.
Figure 5:
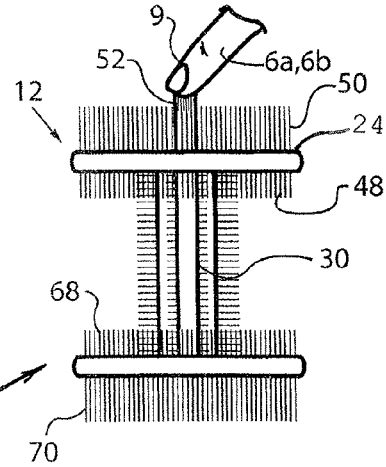
FIG. 5 is a side elevation view of the multipurpose cleaning brush of FIG. 4.

Several examples for carrying out the invention are presented in terms of its present embodiments, herein depicted within FIGS. 1 through 7, with the best mode for carrying out the invention depicted in FIGS. 4-5. However, the invention is not limited to the described embodiments, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

Reference is now made, to FIGS. 1-3, wherein there is shown a multipurpose cleaning brush, generally designated as 10. The brush 10 includes a body 20. The body 20 includes a first portion 22 having each of a top surface 24, opposed bottom surface 26 and a peripheral edge 28. Preferably, each of the top surface 24 and the bottom surface 26 is substantially planar.

There is also a second portion 30 that has each of a first surface thereof 32 disposed on and secured to one of the bottom surface 24 and top surface 26, of the first portion 22. The second portion 30 is sized smaller than the first portion 22 so that the bottom surface 32 of the first portion 22 overhangs the first surface 32 of the second portion 30. The second portion 30 further has an opposed bottom surface 34. In accordance with one form of the invention, the second portion 30 is defined by opposed ends 36 and 40 and has a generally triangular cross-section 42 disposed in a plane generally planar or parallel to the one of the bottom and top surface, 24 and 26 respectively, of the first portion 22 and generally perpendicular to the ends 36, 40. Set of bristles 46 is secured to and extends outwardly from a peripheral surface 44 of the second portion 30. The bristles 46 are attached to the peripheral surface 44 in a conventional manner, for example such as bores (not shown) formed within the second portion 30 or molded integral therewith. Preferably, such bristles 46 have equal height.

In order to use such brush 10 having the body 20 formed by a pair of portions 22 and 30 and set of bristles 46, the user simply grasps the first portion 22, for example using the peripheral edge 28 and positions the second portion 30 between a pair of fingers 6*a* and 6*b* spread in a V-shape manner, as best shown in FIG. 3. The user can then clean the inner surface of each finger 6*a*, 6*b* by moving the brush 10 in a generally linear direction, although other motions are within the scope of this invention. Advantageously, the portion of the set of bristles 46 disposed on and in close proximity to the end 36 is adequate to clean the skin surface 8 disposed in closed proximity to knuckles 7 of the hand 4.

The brush 10 of the present invention may be also provided with a set of bristles 48 secured to and extending outwardly from the bottom surface 26 of the first portion 22 and defining a substantially planar brushing surface for cleaning a portion of the top skin surface 8 of the hand 4 substantially simultaneously with cleaning inner surfaces of fingers 6*a*, 6*b*.

It is also within the scope of the present invention to provide a set of bristles 50 secured to and extending outwardly from the top surface 24 of the first portion 22 and defining another substantially planar brushing surface for cleaning larger area of the hand 4, other areas of the human anatomy or various objects.

Now in a particular reference to FIGS. 4-5, therein is shown a multipurpose cleaning brush, generally designated as 12. As is with the brush 10, the brush 12 has a body 20 with a pair of portions 22 and 30 and a set of bristles 46. To facilitate cleaning of the skin surface 8 as well as being able to clean a larger portion thereof, the end 36 of the second portion 30 of the body 20 has a predetermined concave shape 38 with the vertex thereof disposed below the mid point of the end 36 (where centerline 37 intersects surface 38) to follow the human anatomy in this region of the hand 4. Thus, the portion of the set of bristles 46 disposed on the end 36 also forms a curved brushing surface that generally follows the hand anatomy.

The present invention addresses the long felt need of improving cleaning under the nail plates 9 by providing a set of bristles 52 secured to and extending outwardly from the top surface 24 of the first portion 22. Preferably, free ends of the bristles 52 form a convex arch in a plane generally perpendicular to the top surface 24 of the first portion 22 to accommodate curved nature of the finger tips and ends of nail plates 9. It has been found that bristles 52 of equal height deflect downwardly from a force generated by their contact with the nail plates 9 and finger tips thus forming, temporarily, concave depressions in the outer edge of the row of bristles 52, particularly when the first portion 22 is manufactured from a compressible composite rubber material having memory retention that has been found advantageous in cleaning under the nail plates. Such material may be of the type as employed for manufacturing various products under a "PENWAY" Registered Trademark that can be purchased from Walgreen Co. of Deerfield, Ill. Hence, convexly arching the ends of the bristles 52 substantially eliminates such depressions and facilitates cleaning under the nail plates 9 and other curved portions of the human anatomy. It has been also found advantageous to form such set of bristles 52 as a single row of bristles to assure that the bristles 52 will be lodged under the nail plates 9.

Additionally, it has been found advantageous to provide the set of bristles 52 in combination with the set of bristles 50, wherein longer bristles within the set 52 are located toward the middle of such top surface 22. In this form, the height of bristles 52 will be greater than the height of bristles 50. Preferably, the set of bristles 52 has hardness greater than the hardness of the set of bristles 50, although equal hardness throughout is also within the scope of the present invention. With the brush 12 of this form, the user is capable of generally simultaneously cleaning under the nail plates 9 as well as the tips of the fingers or toes.

In accordance with a presently preferred embodiment of the present invention, the brush 10 includes a third portion 60 having each of a top surface 62, opposed bottom surface 64 and a peripheral edge 66. Preferably, the top surface 62 is substantially planar and the brush 10 further includes a set of bristles 68 secured to and extending outwardly from such top surface 62 and defining a further substantially planar brushing surface.

The bottom surface 64 is also preferably substantially planar and the brush 10 is provided with a set of bristles 70 secured to and extending outwardly from the bottom surface 64 and defining yet another substantially planar brushing surface. The third portion 60 is then manufactured from the same compressible composite rubber material having memory retention as the first portion 22.

When the third portion 60 is provided, the brush 12 is configured so that a predetermined distance is formed between the brushing surfaces defined by set of bristles 48 and 68 for cleaning upper and lower skin surfaces of a pair of adjacent fingers 6*a*, 6*b* as well as upper and lower skin portions of the hand 4 in a substantially simultaneous manner.

The body 20 of the present invention may be manufactured from any conventional plastic and/or rubber materials commonly used for manufacturing existing brushes. Preferably, at least the second portion 30 is manufactured from a substantially rigid plastic material to facilitate cleaning between the pair of fingers 6*a*, 6*b*. Any conventional materials of the body and bristles and attachment methods are contemplated within the present invention and are selected based on a particular application. For example, for surgical and personal hygiene applications, the materials and various attachment methods of the dissimilar body components therebetween and bristles thereto can be of the types taught in U.S. Pat. No. 4,480,351 and U.S. Pat. No. 6,289,547, whose teaching are incorporated into this document by reference thereto.

Figure 6:
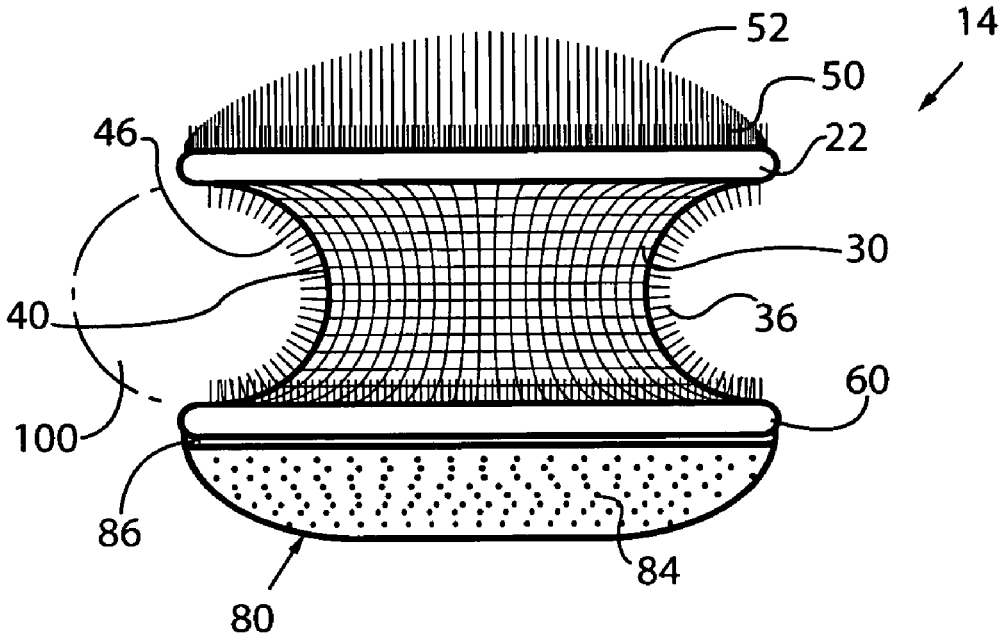
FIG. 6 is a front elevation view of a multipurpose cleaning brush in accordance with yet another form of the present invention.
Figure 7:
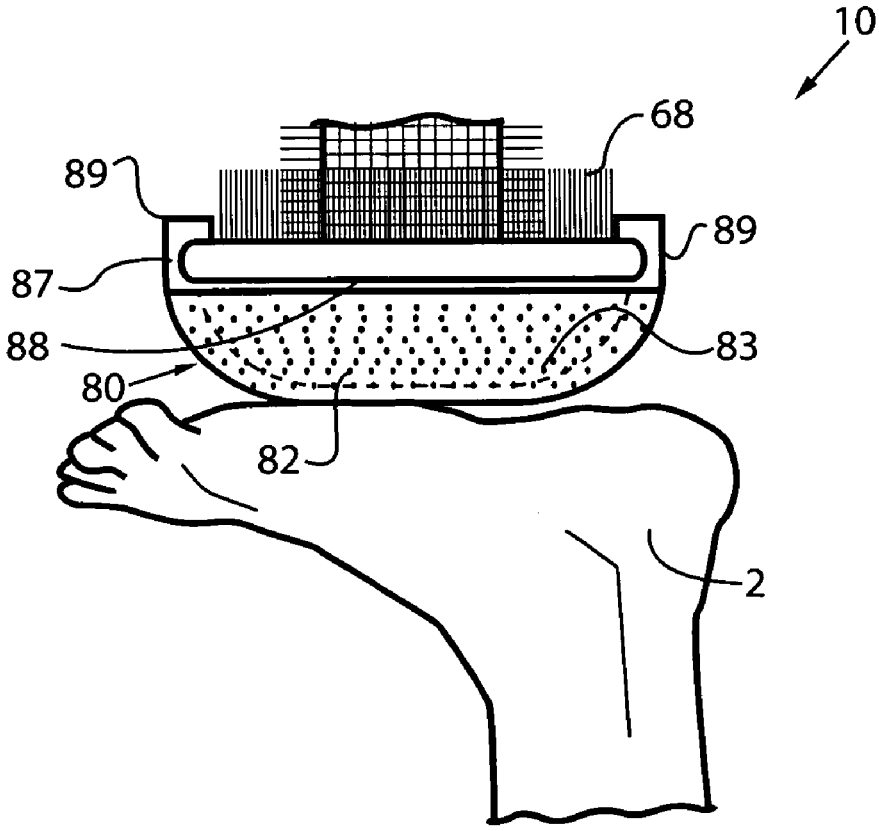
FIG. 7 is a partial side elevation view of the multipurpose cleaning brush of FIG. 6.

Now in a particular reference to FIGS. 6-7, therein is shown a multipurpose cleaning brush, generally designated as 14. As is with the brush 12, the brush 14 has a body 20 with portions 22, 30 and 60 and various sets of bristles. However, instead of the set of bristles 70, the brush 14 is provided with means 80 operatively connected to the bottom surface 64 of the third portion 60 for scrubbing and/or removing skin from a human anatomy, such as a foot 2 and, more particularly, a bottom surface thereof.

Such means 80 includes an abrasive material 84 provided on the bottom surface 64. The material 84 may be of the type as taught in U.S. Pat. No. 6,740,052 issued to Regner or in U.S. Pat. No. 6,142,156 issued to Brunderman and whose teachings are incorporated into this document by reference thereto.

Furthermore, means 80 may include a foot file of a type as manufactured by International Edge, Inc of Fairfield, N.J. under PED EGG™ brand.

If required, the bottom surface 64 may have a predetermined convex shape, although concave shape is also within the scope of the present invention.

Such means 80 may be provided as a separate member 82 that is attachable to the bottom surface 64 with an adhesive 86 which may be of a removable type. Alternatively, the member 82 may be secured to a bracket 87 which has a pair of U-shaped opposed edges 89 that can hook onto the edges of the third portion 60. Thus, the member 82 is removably attached to the third portion 60 and may be easily replaced when the means 84 is no longer effective for scrubbing or exfoliating purposes. The means 80 may be provided with an internal chamber 83 and the middle portion of the bracket 87 may be manufactured generally open so as to vacate any skin fragments accumulated during use, particularly, when the means 80 includes the foot file of a type as manufactured by International Edge, Inc of Fairfield, N.J. under PED EGG™ brand.

In either brush 10, 12 or 14, the second end 40 of the second portion 30 may be also provided with a predetermined concave shape. For example, such shape of the second end 40 may be sized to allow for cleaning of the railing 100 on watercrafts (not shown). Thus, the brush 10 may be employed for both cleaning the railing 100 as well as cleaning the hands 4 and arms of the user cleaning such railing 100.

It will be also appreciated that the brush having concave ends 36, 40 and sets of bristles may be employed for cleaning articles of produce, such as carrots, potatoes, mushrooms and the like.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A multipurpose brush comprising:

(a) a body including:

i. a first portion having each of a top surface, opposed bottom surface and a peripheral edge, and ii. a second portion having each of a first surface thereof disposed on one of said bottom and top surface of said first portion, an opposed bottom surface thereof and a generally triangular cross-section disposed in a plane generally planar to said one of said bottom and top surface of said first portion; and (b) at least one set of bristles secured to and extending outwardly from at least one surface of said body.

2. The multipurpose brush, according to claim 1, wherein said first portion is manufactured from a compressible composite rubber material having memory retention.

3. The multipurpose brush, according to claim 1, wherein said brush includes a set of bristles secured to and extending outwardly from said top surface of said first portion and defining a brushing surface.

4. The multipurpose brush, according to claim 1, wherein said second portion is manufactured from a substantially rigid plastic material.

5. The multipurpose brush, according to claim 1, wherein said second portion includes a pair of opposed ends, each of said pair of opposed ends curving inwardly in a plane generally perpendicular to said one of said bottom and top surface of said first portion.

6. The multipurpose brush, according to claim 1, wherein said brush includes a third portion having each of a top surface thereof disposed on said bottom surface of said second portion, an opposed bottom surface thereof and a peripheral edge thereof.

7. The multipurpose brush, according to claim 6, wherein said bottom surface of said first portion and said top surface of said third portion are disposed substantially parallel to each other.

8. The multipurpose brush, according to claim 6, wherein said third portion is manufactured from a compressible composite rubber material having memory retention.

9. The multipurpose brush, according to claim 6, wherein said brush includes means operatively connected to said bottom surface of said third portion for scrubbing skin of a human anatomy.

10. The multipurpose brush, according to claim 1, wherein said brush includes means operatively connected to said bottom surface of said third portion for removing skin from a human anatomy.

11. The multipurpose brush, according to claim 1, wherein said brush includes a set of first bristles secured to and extending outwardly from said top surface of said first portion and at least one row of second bristles secured to and extending outwardly from said top surface of said first portion, said at least one row of second bristles having height thereof greater than height of said set of first bristles.

12. The multipurpose brush, according to claim 11, wherein free ends of said at least one row of second bristles form a convex arch in a plane generally perpendicular to said top surface of said first portion and wherein longer bristles within said row are located toward the middle of said top surface of said first portion.

13. The multipurpose brush, according to claim 11, wherein said at least one row of second of bristles having hardness thereof being one of equal to and greater than hardness of said set of first bristles.

14. A multipurpose brush comprising:

(a) a body having at least one substantially planar surface, said body further including:

i. a first portion having each of a top surface, opposed bottom surface and a peripheral edge, and ii. a second portion having each of a first surface thereof disposed on one of said bottom and top surface of said first portion, an opposed bottom surface thereof and a generally triangular cross-section disposed in a plane generally planar to said one of said bottom and top surface of said first portion; and (b) a set of bristles secured to and extending outwardly from said at least one substantially planar surface, said set of bristles convexly arched in a plane generally perpendicular to said at least one substantially planar surface, wherein longer bristles within said set are located toward the middle of said at least one substantially planar surface.

15. The brush, according to claim 14, wherein said brush includes a second set of equal height bristles secured to and extending outwardly from said at least one substantially planar surface and wherein the height of said second set of bristles is smaller than the height of said set of arched bristles.

16. A multipurpose brush comprising:

(a) a body including:

i. a first portion having each of a top surface, opposed bottom surface and a peripheral edge, and ii. a second portion having each of a first surface thereof disposed on and secured to one of said bottom and top surface of said first portion, an opposed bottom surface thereof and a pair of ends disposed generally perpendicular to said first portion, wherein at least one of said pair of ends has a predetermined concave shape; and (b) at least one set of bristles secured to and extending outwardly from at least one surface of said body.

17. In combination with at least one portion of a human anatomy, a cleaning brush comprising:

(a) a body including:

i. a top portion having each of a top planar surface, opposed bottom planar surface and a peripheral edge, said top portion manufactured from a compressible composite rubber material having memory retention, ii. a bottom portion having each of a top planar surface, opposed bottom planar surface and a peripheral edge, said bottom portion manufactured from said compressible memory retention composite rubber material, wherein said bottom surface of said top portion and said top surface of said bottom portion are disposed substantially parallel to each other, and iii. a middle portion having each of a top surface thereof disposed on said bottom surface of said top portion, a bottom surface thereof disposed on said top surface of said bottom portion, a pair of opposed ends, each of said pair of opposed ends curving inwardly in a plane substantially perpendicular to each of said bottom surface of said top portion and said top surface of said bottom portion and a generally triangular cross-section disposed in a plane substantially parallel to said each of said bottom surface of said top portion and said top surface of said bottom portion, said middle portion manufactured from a substantially rigid plastic material;

(b) a first set of equal height bristles secured to and extending outwardly from said top surface of said top portion and defining a substantially planar upper brushing surface;

(c) a second set of equal height bristles secured to and extending outwardly from said bottom surface of said top portion and defining a substantially planar first interior brushing surface;

(d) a third set of equal height bristles secured to and extending outwardly from said top surface of said bottom portion and defining a substantially planar second interior brushing surface;

(e) a fourth set of equal height bristles secured to and extending outwardly from said bottom surface of said bottom portion and defining a substantially planar lower brushing surface;

(f) a fifth set of equal height bristles secured to and extending outwardly from a peripheral surface of said middle portion;

(g) a set of variable length nail cleaning bristles secured to and extending outwardly from at least one of said top surface of said top portion and said bottom surface of said bottom portion and having hardness thereof being one of equal to and greater than a respective hardness of said first and third set of bristles, wherein free ends of said nail cleaning bristles form a convex arch in a plane substantially perpendicular to said at least one of said top surface of said top portion and said bottom surface of said bottom portion, and wherein longer bristles within said set of nail cleaning bristles are located toward the middle of said at least one of said top surface of said top portion and said bottom surface of said bottom portion;

(h) whereby a predetermined distance is formed between said first and second inner brushing surfaces for cleaning upper and lower skin surfaces of a pair of adjacent fingers or toes in a substantially simultaneous manner; and (i) whereby a predetermined size of said cross-section of said middle portion enables said fifth set of bristles to clean each of inner skin surfaces of said pair of fingers or toes and skin surfaces disposed in closed proximity to respective knuckles in said substantially simultaneous manner.

18. A multipurpose brush comprising:

(a) a body having at least one substantially planar surface; said body further including:

i. a first portion having each of a top surface, opposed bottom surface and a peripheral edge, and ii. a second portion having each of a first surface thereof disposed on and secured to one of said bottom and top surface of said first portion, an opposed bottom surface thereof and a pair of ends disposed generally perpendicular to said first portion, wherein at least one of said pair of ends has a predetermined concave shape; and (b) a set of bristles secured to and extending outwardly from said at least one substantially planar surface, said set of bristles convexly arched in a plane generally perpendicular to said at least one substantially planar surface, wherein longer bristles within said set are located toward the middle of said at least one substantially planar surface.

* * * * *